United States Patent [19]

Seeley

[11] 3,976,962

[45] Aug. 24, 1976

[54] DUAL THRESHOLD MAGNETIC PROXIMITY SWITCH

[75] Inventor: Robert L. Seeley, San Diego, Calif.

[73] Assignee: The United States of America as represented by the Secretary of the Navy, Washington, D.C.

[22] Filed: Apr. 25, 1975

[21] Appl. No.: 572,473

[52] U.S. Cl. ..... 335/153; 335/179; 335/207

[51] Int. Cl.[2] ..... H01H 51/22

[58] Field of Search ..... 335/153, 205, 206, 207, 335/179

[56] References Cited

UNITED STATES PATENTS

| | | | |
|---|---|---|---|
| 3,707,690 | 12/1972 | Sakatos | 335/153 |
| 3,906,476 | 9/1975 | Yonezu | 335/153 |

*Primary Examiner*—Harold Broome
*Attorney, Agent, or Firm*—Richard S. Sciascia; Ervin F. Johnston; Thomas Glenn Keough

[57] ABSTRACT

An improved dual threshold switch is actuated by magnetic fields in the switch's proximity. An elongate glass envelope contains a pair of reed contacts. The contacts are biased by a piece of donut-shaped magnetic material circumscribing the envelope to be switched to a closed position at one magnetic threshold or an open position at another magnetic threshold. Both magnetic thresholds are induced in the contacts by external actuating magnets and the thresholds can be changed by physically moving the donut along the elongate glass envelope. A coil is provided and encompasses the envelope and magnetic donut to provide an electro-magnetic field which shifts the biasing field induced by the donut. When the electromagnetic shifting field is turned on the thresholds established by the biasing field are shifted so that the contacts would be actuated from external actuation fields at different magnetic thresholds. This feature gives flexibility since various combinations of weak or strong external magnetic fields can be employed as the situation demands without sacrificing reliability or calling for extensive modifications of the switch. A delay circuit energizes or initiates the coil to provide the electromagnetic shifting field upon the occurrence of a variety of conditions such as the passage of time, the changing of the tide, the proximity or absence of external electric, gravitational or magnetic fields, for example.

2 Claims, 4 Drawing Figures

DUAL THRESHOLD MAGNETIC PROXIMITY SWITCH

STATEMENT OF GOVERNMENT INTEREST

The invention described herein may be manufactured and used by or for the Government of the United States of America for governmental purposes without the payment of my royalties thereon or therefor.

BACKGROUND OF THE INVENTION

Switches actuated by external magnetic fields have been in existence for a number of years. Usually, however, only a single magnetic threshold needs to be crossed to move read contacts from an open to a closed, or a closed to an open position. There have been attempts to make a reliable bistable switch which goes to one state when an external field is applied and then to the other state when a reverse magnetic field is brought into the switch's proximity. A small magnetic chip was mounted on one side of a reed switch to arrive at a degree of self magnetic biasing.

This approach, while effective to a degree, has drawbacks. It is a laborious and time consuming task to mount the chips on the reed switches. The different shapes and problem of aligning the biasing field with the contacts make the bonding of them together tedious. In addition, if the actuating magnetic fields are too strong, the magnetic chip may become depolarized or repolarized and render the switch useless. These problems have been avoided by the present inventor's co-pending U.S. patent application Ser. No. 571,658 entitled "Reliable Magnetically Biased Reed Switch". Yet the co-pending invention does not include the capability for providing a dual threshold switch which is capable of changing its magnetic thresholds of actuation to different levels without physically modifying the apparatus. Thus, there is a continuing need in the state of the art for such a reliable, variable dual threshold switch which inherently possesses a high degree of reliability due to its simplicity of design.

SUMMARY OF THE INVENTION

The present invention is directed to providing an improved dual threshold switch having an elongate, dielectric envelope containing a pair of reed contacts actuatable to an open position and a closed position by external magnetic actuation fields. Means are carried on the elongate dielectric envelope for magnetically inducing a 360° magnetic biasing of the reed contacts to the open position and a closed position at two magnetic thresholds. Another means is disposed circumferentially outwardly from the magnetic biasing means for inducing a 360° electromagnetic shift of the 360° magnetic biasing field. This shifting electromagnetic field establishes different magnetic thresholds at which the reed contacts are magnetically actuated to the open position and the closed position. The actuating distance between an external actuating magnetic field and the switch may thereby be controlled by the electrical current through the electromagnetic coil. The positive or negative flow of current determines whether the induced electromagnetic field aids or counters the permanent magnetic bias field and therefore whether the actuation distance will be shorter or longer for the same actuating magnetic field.

The prime object of the invention is to provide an improved, dual threshold switch.

Yet another object is to provide a switch having increased reliability because of the uncomplicated mode of assembly.

Yet another object is to provide a dual threshold magnetic switch having the capability for varying both levels of actuation.

Still another object is to provide a dual threshold switch which automatically changes its thresholds of actuation upon the occurrence of a predetermined condition.

Still another object is to provide a switch which induces a 360° electromagnetic field, shifting 360° magnetic biasing of the switches' contacts.

Another object is to provide a dual threshold switch having the capability for varying its own two magnetic thresholds established by the axial positioning of a donut-shaped piece of magnetic material by a circumferentially disposed coil.

These and other objects of the invention will become more readily apparent from the ensuing description when taken with the drawings.

DESCRIPTION OF THE PREFERRED EMBODIMENT

Figure 1:
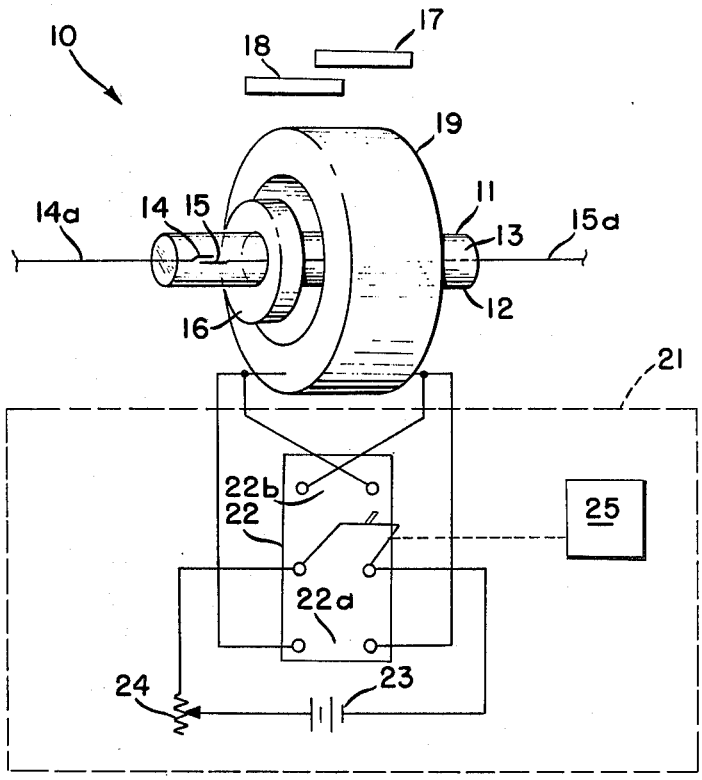
FIG. 1 is an isometric depiction of the invention.

Referring now to the drawings, FIG. 1 shows a representative embodiment of an improved dual threshold switch 10. A conventional reed switch 11 includes an elongate glass envelope 12 which defines the boundaries of a chamber 13 filled with an inert gas. A pair of reed contacts 14 and 15 are disposed in the chamber and are mechanically biased to provide bistable operation. Leads 14*a* and 15*a* extend to a remotely disposed electronic package and serve to complete a circuit in the package when contacts 14 and 15 are closed.

A donut shaped biasing magnet 16 is fashioned from a sheet of a magnetic material. The sheet of magnetic material is a rubber-bonded barium-ferrite material of the type commercially sold by the 3M Company of St. Paul, Minnesota. It is marketed under the trade designation, "Plastiform Magnet Material BX-1013". This material has a high resistance to demagnetization and has a properties which allow its being machined and drilled into the donut shape with ease. It is magnetized to have poles on opposite faces and holds the flux patterns close to the element to which it is to magnetically influence. In the present case, the influencing of contacts 14*a* and 15 is of interest and by placing the donut shaped magnet closer or further away from the contacts different magnetic thresholds for actuation of the switch's contacts are created routinely.

The magnetic donut is provided with a lateral opening sized to snugly accommodate the outer surface of elongate glass envelope 12. Because of the snug fit, the biasing magnet is capable of being moved along the length of the elongate envelope and frictionally holds itself in place once a particular location has been slected. Just where this location is on the envelope determines the magnetic threshold levels at which contacts 14 and 15 open and close.

The contacts are opened or closed according to magnetization induced in them by a pair of remotely disposed actuating magnets 17 and 18 which have their poles oppositely oriented with respect to each other. The actuation magnets are located radially outwardly from the longitudinal axis of the elongate glass envelope a predetermined distance and their actuating magnetic fields open or close the reed contacts when an actuating magnet field is added to or overcomes the biasing influence of donut shaped magnet 16.

Figure 2:
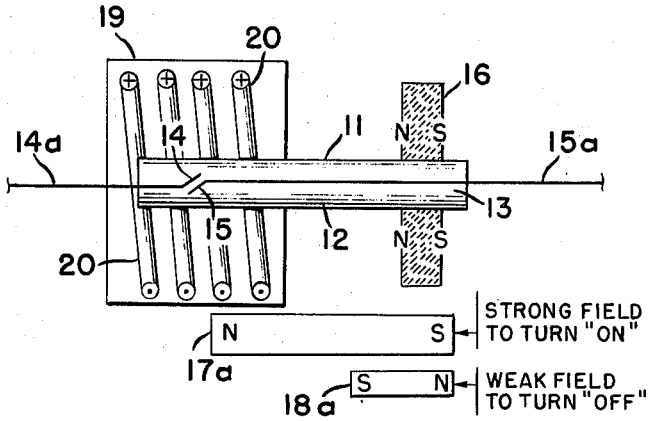
FIG. 2 is a cross-sectional representation of the invention having first and second preset magnetic thresholds for actuation being altered by a shifting electromagnetic field.
Figure 3:
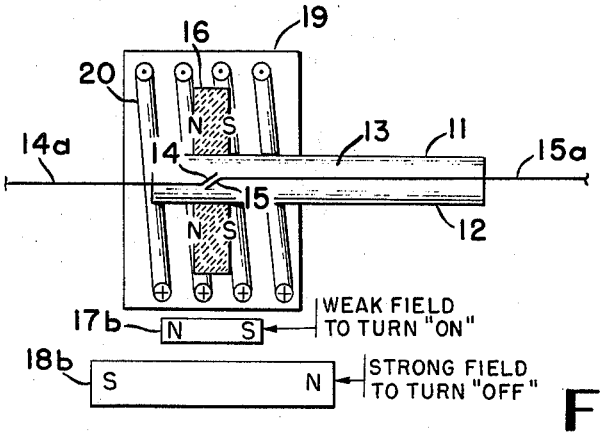
FIG. 3 is a cross-sectional view of the invention, having third and fourth preset magnetic thresholds being altered by a shifting electromagnetic field.
Figure 4:
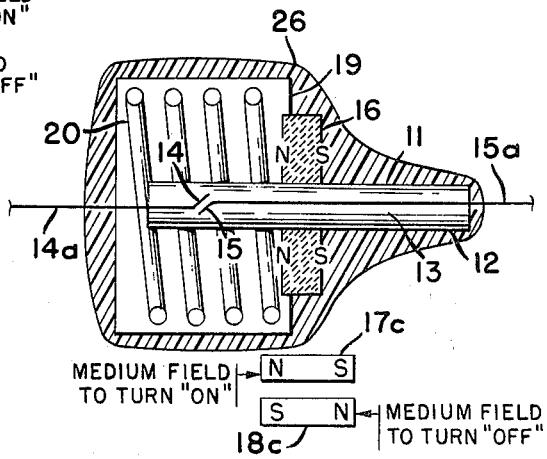
FIG. 4 is another cross-sectional view of the invention configured so as to be actuated at yet another pair of magnetic thresholds with no shifting electromagnetic field being induced by the coil.

Looking now to FIGS. 2, 3, and 4, it can be seen how the location of the donut shaped magnet on the elongate envelope establishes the magnetic thresholds at which contacts 14 and 15 are opened or closed. At this point, it should be mentioned that the relative locations of the donut shaped magnet to the contacts are shown in a greatly exaggerated scale. This is done to focus a reader's attention on the fact that the longitudinal displacements of the donut with respect to the contacts do, in fact, create differential magnetic threshold levels required for actuation by an external field. In actual practice, using a conventional reed switch having an elongate glass envelope only two centimeters long, the axial displacement of the donut was no more than a few millimeters in either direction, to widely vary the actuation threshold. Therefore, the exaggerated showings of FIGS. 2, 3, and 4 are not meant to be taken as the actual relative locations of the magnetic donut on the envelope.

Noting FIG. 2, the magnetic donut is mounted far to the right and a large portion if its biasing flux is drawn to that portion of the lead 15*a* lying to the right of contact 15. A smaller portion of the total biasing flux is attracted to conductor 14*a* where it reaches to the left of contact 14. Thus, there is a relatively low level of magnetism induced between the contacts and an external actuating magnetic field must be relatively strong to induce enough magnetism between the two contacts to close them and turn the external circuit on. A strong actuating field is schematically depicted by a relatively large actuating magnet 17*a* which must be brought in the radial proximity of the switch.

After the switch has been turned on, and actuating magnet 17*a* is removed, the small amount of induced magnetism between contacts 14 and 15 from the biasing field of magnetic donut 16 holds the contacts together. However, when a relatively weak actuating magnetic field is induced on the contacts from a small actuating magnet 18*a*, which opposes the induced field, the contacts separate easily.

The opposite effect happens when the magnetic donut is slid to the far left of the elongate glass sleeve as shown in FIG. 3. The biasing magnetic field from the magnetic donut more strongly induces magnetism between contacts 14 and 13 and urges them to close. All that is needed to close the contacts is to place a small actuating magnet 17*b* near the switch which eminates a relatively weak field. The biasing field plus the weak actuation field induce sufficient magnetism in the reed contacts to close them. On the other hand, a strong or large actuating magnet 18*b* is needed to produce a relatively strong field for opening the contacts, and switch off the circuit associated with the remote electronnic package.

Apropriately locating magnetic donut 16 as shown in FIG. 4 permits the contacts to be opened and closed by a pair of actuation magnets 17*c* and 18*c* having magnetic fields of substantially the same magnitude yet opposite directions. When either one are brought in the radial proximity of the switch, the contacts responsively open and close.

The inclusion of a coil 19 circumferentially about the magnetic donut and reed switch provides a capability for altering the biasing field of the magnetic donut and hence for shifting the magnetic thresholds. The electromagnetic field caused by a current flowing through windings 20 of the coil and the direction of current flow influences which way the magnetic thresholds shift for responsive actuation of the switch.

While what has been described concerns itself with providing actuation magnets of different magnitudes with respect to each other, the present invention need not be so restricted. A single magnet optionally is used and is positioned at different separations from the switch to create the relatively weak and strong actuation fields.

Current from an initiation circuit 21 is fed to the windings of the coil. A switch 22 allows a current flow in one direction when the switch is at position 22*a* or the opposite direction when the switch is at position 22*b*. Potential or current source 23 provides for producing the overriding field at a magnitude preset by a potentiometer 24. Although a double pole double throw switch is shown, it is within the teachings of the present invention to substitute a variety of switching devices, be they electronic or mechanical.

A suitable delay mechanism 25 is electronically or mechanically coupled to the switch to effect the proper actuation. The delay mechanism optionally is no more than a suitably connected clock which either couples or uncouples the initiating circuit from the coil windings after the mere passage of time. Or, the mechanism could be actuated when, for instance, the tide reaches a certain level or it could be a device which actuates the switch 22 when a certain physiological event occurs.

In any event, the function of the initiation circuit as controlled by the delay mechanism is to deliver an overriding magnetic field to bistable switch 10 and gives a designer great latitude in use of a switch. For example, after two predetermined thresholds for opening or closing the contacts have been established, there still may be some reason that the degree of sensitivity, which the switch now has, makes conditions dangerous for a period of time. By switching the proper polarity of the overriding magnetic field the switch is made relatively insensitive to possible ambient magnetic fields and is rendered incapable of changing state. Then, after conditions change or a predetermined time has elapsed delay mechanism trips switch 22 from either position 22*a* or 22*b* and reed switch 10 is free to be actuated by magnetic fields at the predetermined magnetic thresholds.

More specifically, in the embodiment of FIG. 2, which normally requires a strong field to turn it on from actuating magnet 17*a* or a relatively weak field to turn it off from actuating magnet 18*a*, switch 22 is actuated to connect source 23 to the contacts at position 22*a*. Current flows in the windings as depicted in FIG. 2. The magnetic field induced by the windings shifts the total biasing magnetic field with the shifting electromagnetic field opposing the donut's field. An external actuating field need be of only a small magnitude to close contacts 14 and 15 whereas a strong external magnetic actuating field is required to open the contacts. Of course, the shifting field can have the polarity to require an even larger actuation magnetic field to close the contacts than before and a smaller actuation field to open the contacts.

If, on the other hand, switch 22 is actuated to connect current source 23 to the contacts in position 22*b*, the result is the opposite, noting FIG. 3. Where formerly a weak field from actuating magnet 17*b* was sufficient to close contacts 14 and 15, now a much larger field is required to close the contacts and similarly, whereas before a strong magnetic field from actuating magnet 18*b* was needed to open the contacts, now a much weaker field accomplishes the same task.

The arrangement shown in FIG. 4 can have its thresholds changed either way by applying a current of either polarity to the windings. By inclusion of the coil an electromagnetic field of either polarity can accommodate changing conditions to ensure more reliable actuation or greater safety to those in the near vicinity.

Being able to influence the switch by the shifting magnetic field as described above operates as a great safety factor to personnel involved with the hazardous substances, such as chemicals or explosives. With the workmen or technicians in the near vicinity of the substances any further chemical reactions or mechanical operations can be inhibited while the shifting magnetic field overrides the magnetic field acting on the switch. After a predetermined time and after all have withdrawn to a safer location, the initiating circuit is automatically disconnected from the windings.

Reliability is enhanced by potting the switch in an epoxy coating 26. The switch now has a permanence that permits its use in harsh environments and does not allow the magnetic donut to be rattled loose to establish new thresholds.

Obviously, many modifications and variations of the present invention are possible in the light of the above teachings, and, it is therefore understood that within the scope of the disclosed inventive concept, the invention may be practiced otherwise than specifically described.

What is claimed is:

1. In a dual threshold switch having an elongate dielectric envelope containing a pair of read contacts actuatable to an open position and a closed position by external magnetic actuation fields originating beyond the physical dimensions of the switch, an improvement therefor is provided comprising:

a donut shaped piece of rubber-bonded barium-ferrite magnetic material having a lateral opening sized to frictionally engage the outer surface of the elongate dielectric envelope to allow its selective mounting thereon, the donut shaped magnetic material induces a 360° magnetic biasing of the reed contacts for magnetically biasing the reed contacts to the open position and closed position at two magnetic thresholds;

a coil that includes a 360° magnetic force overcoming the 360° magnetic biasing of the donut shaped magnetic material disposed circumferentially outwardly from the donut shaped piece of magnetic material for electromagnetically shifting the biasing field of the donut shaped magnetic material to establish different magnetic thresholds from which external magnetic actuation fields originating beyond the physical dimensions of the switch magnetically actuate the reed contacts to the open position and the closed positions;

means electrically coupled to the coil for initiating the shift of the magnetically biasing mean's field; and means enveloping the dielectric envelope and reed contacts, the donut shaped piece of rubber-bonded barium-ferrite magnetic material and the coil for dielectrically potting them therein to ensure more reliable operations.

2. An improved dual threshold switch according to claim 1 in which the initiating means is a current source coupled to a delay mechanism for generating the 360° magnetic force upon the occurrence of a predetermined condition.

* * * * *